United States Patent [19]

Steyer

[11] 4,137,599

[45] Feb. 6, 1979

[54] SUCTION SYSTEM FOR CLEANING CARPET AND THE LIKE

[76] Inventor: Chester G. Steyer, 8224 Greenock Dr., Bon Air, Va. 23235

[21] Appl. No.: 692,280

[22] Filed: Jun. 3, 1976

[51] Int. Cl.[2] ..... A47L 7/00

[52] U.S. Cl. ..... 15/300 A; 15/321; 15/353

[58] Field of Search ..... 15/300 A, 320, 321, 15/322, 352, 353

[56] References Cited

U.S. PATENT DOCUMENTS

| | | | |
|---|---|---|---|
| 2,763,886 | 9/1956 | Brown et al. | 15/321 |
| 3,747,155 | 7/1973 | Koellisch | 15/321 X |
| 3,959,844 | 6/1976 | Cyphert | 15/320 |
| 3,974,541 | 8/1976 | Silvis et al. | 15/322 X |

FOREIGN PATENT DOCUMENTS

| | | | |
|---|---|---|---|
| 2328941 | 1/1975 | Fed. Rep. of Germany | 15/321 |

*Primary Examiner*—Christopher K. Moore
*Attorney, Agent, or Firm*—Walter G. Finch

[57] ABSTRACT

The invention generally relates to cleaning of carpets, upholstery and the like by "wet" processes such as the hot water extraction process. In particular, the invention provides an improved method and apparatus for cleaning surfaces comprised of fabric or fabric-like material wherein a cleaning liquid is sprayed over the surface immediately prior to subjecting said surface to suction, such as by a vacuum apparatus. The apparatus is provided with a cleaning head having a vacuum motor mounted thereon to increase the vacuum being pulled at the inlet to the cleaning head, a certain vacuum level being usually pulled by vacuum apparatus in a mobile tank remote from the cleaning head. Sediment-laden liquid pulled into the cleaning head is channeled to the remote mobile tank while only air is pulled through the vacuum motor mounted on the cleaning head.

5 Claims, 5 Drawing Figures

SUCTION SYSTEM FOR CLEANING CARPET AND THE LIKE

BACKGROUND OF THE INVENTION

A. Field of the Invention

The invention relates to cleaning apparatus and methods for cleaning environmental surfaces, particularly surfaces comprised of woven, knitted, or pile-like fabric, whereby the surface is pre-treated with a cleaning liquid prior to application of a suction force to the surface.

B. Brief Description of the Prior Art

Prior art cleaning systems used to remove sediment deposited on and embedded into environmental surfaces, particularly rugs and fabric-covered furniture, have relied primarily on the application of a suction action to lift the sediment from such surfaces. As used herein, sediment is intended to refer to dust, soil, grit, films of oily grease-like substances, and the like which are foreign to the surface which is to be cleaned. Certain cleaning systems have also provided a sweeping or brushing action in an attempt to loosen embedded sediment in a rug of fabric. This predisengagement of sediment from an embedded position in the article being cleaned presents the sediment to a subsequently applied suction force in a more favorable aspect for removal thereby. While these "dry" systems have proven more effective than the simple application of a suction force alone, the art of cleaning rugs and furniture without removal thereof from their points of use has not advanced to the point of providing complete satisfaction to the users of the articles to be cleaned. "Wet" systems have been employed for the purpose of "shampooing" rugs and furniture using foaming substances and rotary scrubbing apparatus. Certain "wet" systems also apply suction force to the article being cleaned for removing the applied liquid material immediately after the application thereof to the article. In these systems, the liquid cleaning material soaks the article and, on drying thereof, tends to leave a heavy detergent residue in the article. The sediment which is embedded relatively deeply into the rug or fabric is also not removed by the "shampoo" system but is partially dissolved and then settles even more deeply into the rug or fabric. Also, application of liquids to fabric-like material also can cause damage and shrinkage. The "wet" systems which combine liquid application with immediate removal of the liquid by vacuum means also allow a certain degree of "soaking" of the liquid prior to removal thereof from the surface. Thus, prior dry and wet systems have disadvantages which make their use less than fully satisfactory. These prior art systems generally are only effective in removing the "top layer" of relatively loose sediments which become embedded in environmental surfaces under normal use. The present invention provides a method and means for removing embedded sediment in environmental surfaces, such as carpets, rugs, and fabric-covered furniture, which overcome the disadvantages encountered in the practices of the prior art, primarily by increasing the suction force available to remove the liquid from the surface.

SUMMARY OF THE INVENTION

The invention is embodied in an improved method and apparatus for the practice thereof. The present invention loosens and removes sediment from an environmental surface, such as a rug or carpet, which sediment usually remains embedded in such surface when subjected to the less efficient cleaning action of prior art vacuum or shampoo cleaning systems. Use of the present invention loosens this embedded sediment and immediately removes said sediment from the article being cleaned. In order to practice the invention, a liquid spray is directed against the article to be cleaned in order to loosen sediment lying on and embedded in the article. The liquid spray is directed against the article immediately prior to application of a suction force to the article. Thus, the article is wetted by a rapid spray action and is then immediately subject to a suction force, the suction force being increased over prior art apparatus by the provision of a vacuum unit mounted immediately above the cleaning head of the apparatus. Thus the liquid detergent or aqueous detergent solution is accelerated more rapidly through the article to increase the cleaning action thereof. The cleaning liquid is not allowed to simply soak into the article prior to vacuum removal but is accelerated to provide increased "loosening" and sediment-removing action, thereby resulting in a drier and a cleaner article.

It is therefore an object of the invention to provide a method and apparatus for more efficiently removing embedded sediment from an environmental surface, particularly rugs, carpets, fabric-covered furniture, and the like.

A further object of the invention is to provide means mounted on the cleaning head of a vacuum cleaning apparatus of the hot water extraction type which produces a supplementary vacuum force to increase the vacuum level applied to the article being cleaned.

Further objects and advantages of the invention will become more readily apparent in light of the following detailed description of the preferred embodiment of the invention.

DESCRIPTION OF THE PREFERRED EMBODIMENT

Figures 1, 2, 3, 4, 5, 6:
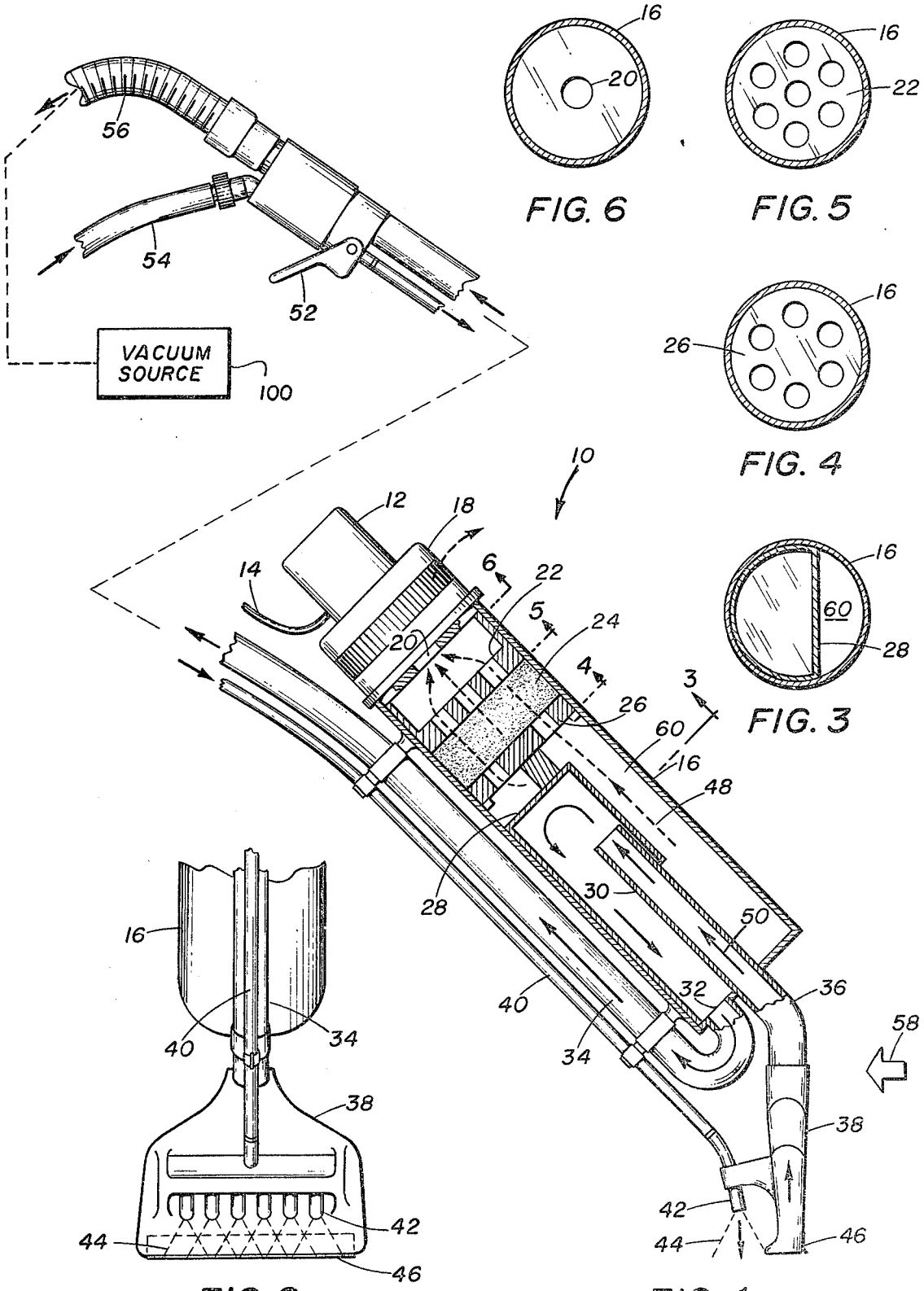
FIG. 1 is an elevational view in partial section of an apparatus embodying the invention.
FIG. 2 is an elevational view of the cleaning head of the apparatus of FIG. 1.
FIG. 3 is a section taken along the line 3 of FIG. 1.
FIG. 4 is a section taken along the line 4 of FIG. 1.
FIG. 5 is a section taken along the line 5 of FIG. 1.
FIG. 6 is a section taken along the line 6 of FIG. 1.

Referring first to FIGS. 1 and 2, the invention is shown at 10 to be mounted on a rigid hose or "wand" 34 immediately surmounting cleaning head 38. The apparatus is generally of the type used in the "hot water extraction" cleaning process. A cleaning solution is sprayed onto a surface which is to be cleaned through one or more nozzles 42, the nozzle 42 being supplied with the solution through a liquid delivery hose 40 and manifold unit. Flow of the solution into the delivery hose 40 is controlled by a control trigger 52 which operates valving to a flexible supply hose 54. A liquid return hose 56 couples to the wand 34 near the point of connection of the hose 54 to the hose 40. The cleaning liquid is pumped through the hose 54 from a source (not shown) which could be of the well-known mobile caster type. A vacuum is created within the wand 34 by means of a vacuum source 100 which can also be located in a mobile unit or at a relatively stationary location such as is well-known in the art. Alternatively, the vacuum pump source 100 which creates vacuum in the wand 34 may be portable and locatable over any type of water collection device such as a bath, toilet or floor drain.

Cleaning liquid is applied through the nozzles 42 to the surface being cleaned in either a liquid form or as a "wet" steam as at 44 in a known fashion. Relative to the direction of motion 58 of the cleaning head 38 when in operation, the head 38 is disposed adjacent to and behind the nozzles 42. The head 38 contacts the surface being cleaned and draws the liquid, which has just been sprayed onto the surface, back out of the material comprising the surface. The apparatus and operation thereof described until now are known in the art.

As particularly seen now in FIG. 1, the cleaning head 38 does not connect directly to the wand 34 as in prior art cleaning apparatus of this type. Instead, a curved tube 36 joins the head 38 to a vacuum cylinder 16 which is mounted on the wand 34 above the cleaning head 38, the tube 36 extending into the interior of the cylinder 16 as will be described hereinafter. A motor 12 and vacuum fan 18 are mounted on the opposite end of the cylinder 16 and act to draw a vacuum within the cylinder 16. The cylinder 16 communicates with the wand 34 at port 32 in the first-mentioned end of the cylinder, the wand 34 undergoing a U-shaped bend immediately outside of the port 32. Thus, additional vacuum is created within the cylinder 16 (and thus at the inlet of the cleaning head 38) as a result of the vacuum being drawn through the wand 34 as described above. The vacuum drawn by the motor 12 and fan 18 within the cylinder 16 substantially increases the level of vacuum force at the inlet to the cleaning head 38, thereby resulting in greater acceleration of the liquid through the article being cleaned. Sediment embedded in the article is therefore more efficiently loosened for removal and the article is dried more thoroughly. The motor 12 and fan 18 are operated by electric power supplied through a connecting wire 14.

The cylinder 16 has internal means for separating the liquid being pulled thereinto from the air. As seen in FIGS. 1 and 3, a deflector cup 28 is disposed near the end of the cylinder where the tube 36 and the wand 34 communicate with said cylinder. The deflector cup 28 is seen in FIG. 3 to be substantially cylindrical except for an upper flattened portion which partially defines an air channel 60, the cup 28 lying flushly against the lower and side portions of the cylinder 16. An extension 30 of the tube 36, extends into the cup 28 at the upper inlet portion of said cup. Fluid entering the cylinder 16 through the extension 30 is caused to impinge against the rear wall of the cup 28 and is thereby caused to undergo a 180° change of direction, the water portion of the fluid then moving toward the lower portion of the cup 28 (and cylinder 16) under the influence of gravity. Liquid (and some air) flowing to the lower portion of the cup 28 enters the outlet port 32 at the entrance to the U-shaped bend in the wand 34, the liquid being removed through the wand 34 as aforesaid. The vacuum source 100 connected to the wand 34 is selected to pull a greater vacuum then does the motor 12 and fan 18. Thus, the liquid and air immediately above the port 32 is always pulled through the wand 34.

Air brought into the cylinder 16 through the cleaning head 38 moves from the cup 28 and through the air channel 60 between the upper portion of the cup 28 and the inner wall of the cylinder along an air flow path 38. Most of the air rises from the entraining water flow path and is pulled by the motor 12 and fan 18 from the cylinder 16 through the upper end thereof. The air passes through port holes disposed in annular filter plates 22 and 26 which enclose a filter 24, the filter preventing movement of dust and lint into the vacuum fan 18. The filter 24 can be a plastic sponge, brass-covered steel, etc. The plates 22 and 26 slidably fit into the cylinder 16 and are held in place by a suitable stop detent. The plate 26 is further cemented to the rear exterior wall of the cup 28 through a connecting spacer plug. The plate 22 has annular perimetric side walls formed integrally thereon which spaces said plate from the upper end of the cylinder 16. The upper end of the cylinder 16 has an air output opening 20 formed centrally therein through which the motor 12 and fan 18 pulls the air and thereby creates vacuum force within the cylinder 16.

The cylinder 16 could be formed as a housing of a different geometrical shape. Similarly, the cup 28 could be formed into a different configuration, the salient feature of the invention being the separation of the liquid from the air so that the sediment-laden liquid can be drawn through the wand 34 to a liquid disposal point. Only air is drawn from the cylinder 16 by the motor 12 and fan 18 in order to create a local vacuum force of a level sufficient to increase liquid flow through the fibers of the article being cleaned. Thus, the invention can be practiced other than as specifically shown and described, the invention being limited only by the scope of the appended claims.

What is claimed is:

1. Apparatus for removing sediment from an article to be cleaned, comprising:

liquid applying nozzles on a manifold connected to a delivery hose from a supply source for applying a cleaning liquid to the surface of the article to loosen embedded sediment on the surface of the article and in the article;

a cleaning head having a distal end portion which contacts the surface of the article subsequent to the application of the cleaning liquid thereto;

a first vacuum source known in the art disposed in a relatively remote and relatively stationary location from and relative to the remaining portions of the apparatus for creating a vacuum over the area of contact between the distal end portion of the cleaning head and the surface of the article;

vacuum lines disposed between said first vacuum source and the cleaning head for connecting said first vacuum source and the cleaning head, said vacuum lines consisting of a liquid return hose connected to a wand tube, said wand tube connected to a cylinder, said cylinder having a tube inlet at the lower end, said liquid return hose being connected to said vacuum source and said tube inlet being connected to said cleaning head;

a second vacuum source mounted on said cylinder in surmounting relation to the cleaning head for creating a vacuum additional to that provided by the first vacuum source, thereby producing in cummulative fashion a relatively greater vacuum level over the area of contact between the cleaning head and the surface of the article than would be created by the first vacuum source alone, the cleaning head being connected to the tube inlet of the vacuum lines for directly applying the effects of the vacuum created by the first and second sources to the surfaces of the article being cleaned; and deflecting means within said cylinder to deflect and change direction of sediment-laden liquid and the comingled air entering the cleaning head, the sediment-laden liquid being channeled into at least a portion of said vacuum lines with some comingled air, a major portion of said comingled air moving toward second vacuum source after the deflection and change of direction and being vented from the second vacuum source to ambient, said deflecting means consisting of an extension connected to said tube inlet, said extension projecting partly into and spaced from a deflector cup, said deflector cup being located within said cylinder at the lower end thereof, the lower end of said deflector cup partly surrounding and communicating with connection of said wand tube with said cylinder.

2. The apparatus of claim 1 wherein the liquid applying means comprise:

hose means for delivering the cleaning liquid from a supply source to a manifold in the vicinity of the article to be cleaned;

nozzle means on said manifold on the end of said hose means for spraying said cleaning liquid on the surface of the article; and spray control means connected to said hose means for regulating the application of said cleaning liquid to the article.

3. The apparatus of claim 1 wherein the second vacuum source comprises:

a motor; and a vacuum fan connected to said motor and affixed, together with said motor to which connected, to the upper end of said cylinder, said vacuum fan communicating with the interior of said cylinder and with the ambient.

4. The apparatus of claim 1 and additionally filter means located within said cylinder and between the second vacuum source and the tube inlet for preventing foreign matter from entering the second vacuum means.

5. The apparatus of claim 4 and additionally plate means having at least one aperture therein and mounting the filter means within said cylinder between said second vacuum source and said tube inlet.

* * * * *